US008925216B2

(12) United States Patent
Lutz

(10) Patent No.: US 8,925,216 B2
(45) Date of Patent: Jan. 6, 2015

(54) CLOTHES DRYING APPARATUS

(75) Inventor: James Lutz, Pewaukee, WI (US)

(73) Assignee: James M. Lutz, Pewaukee, WI (US)

( * ) Notice: Subject to any disclaimer, the term of this patent is extended or adjusted under 35 U.S.C. 154(b) by 235 days.

(21) Appl. No.: 13/594,423

(22) Filed: Aug. 24, 2012

(65) Prior Publication Data

US 2013/0055582 A1 Mar. 7, 2013

Related U.S. Application Data

(60) Provisional application No. 61/527,510, filed on Aug. 25, 2011.

(51) Int. Cl.
*F26B 25/06* (2006.01)
*D06F 57/12* (2006.01)
*D06F 57/06* (2006.01)

(52) U.S. Cl.
CPC ..... *D06F 57/12* (2013.01); *D06F 57/06* (2013.01); *D06F 57/125* (2013.01)
USPC ..... 34/237; 211/100; 248/181.1; 68/3 R

(58) Field of Classification Search
USPC ..... 34/80, 90, 104, 105, 201, 210, 237; 211/34, 96, 100; 248/27.8, 181.1; 68/5 C, 3 R
See application file for complete search history.

(56) References Cited

U.S. PATENT DOCUMENTS 78,902 A * 6/1868 Stillman ..... 211/96
1,552,268 A * 9/1925 Brannin ..... 34/188
1,709,352 A * 4/1929 Judelson ..... 312/334.25
2,377,255 A * 5/1945 McCauley ..... 34/233
3,612,284 A * 10/1971 Stoltz ..... 211/1.3
3,696,523 A * 10/1972 Beeley et al. ..... 34/216
3,960,274 A * 6/1976 Trueb ..... 211/1.3
4,094,414 A * 6/1978 Thiot et al. ..... 211/1.3
4,127,195 A * 11/1978 Portnoy ..... 211/100
4,632,255 A * 12/1986 Kennedy ..... 211/1.3
4,682,424 A * 7/1987 Irving ..... 34/621
4,771,895 A * 9/1988 Steiner ..... 211/1.3
4,819,812 A * 4/1989 Demarest, Jr. ..... 211/1.3
4,886,172 A * 12/1989 Kummerlen ..... 211/85.3
5,240,128 A * 8/1993 Ohm ..... 211/197
6,189,708 B1 * 2/2001 McNeece ..... 211/105.1
6,454,109 B1 * 9/2002 Doyle et al. ..... 211/119.01

(Continued)

FOREIGN PATENT DOCUMENTS

GB 2063807 A * 6/1981 ..... B65G 49/00
JP 2008279199 A * 11/2008

*Primary Examiner* — Steve M Gravini
(74) *Attorney, Agent, or Firm* — Michael Best & Friedrich LLP

(57) ABSTRACT

A clothes drying apparatus mounted to a building structure (e.g., a ceiling, wall, or floor) and including a slider track coupled to the building structure, and a frame (e.g., at least two frames) secured to the slider track for sliding between a stored position and an extended position. The frame is pivotable relative to the building structure. For example, the frame can be secured to the slider track, and the slider track can be pivotable relative to the building structure. Preferably, the slider track includes an inner member coupled to the building structure and an outer member coupled to the frame. The apparatus can further include transverse brackets supporting the slider track. For special mounting situations, the apparatus can further include longitudinal brackets supporting the transverse brackets and/or a back mounting bracket at least partially supporting the transverse brackets.

18 Claims, 13 Drawing Sheets

(56) References Cited

U.S. PATENT DOCUMENTS

| | | | | |
|---|---|---|---|---|
| 7,127,829 | B2 * | 10/2006 | Wuster | 34/239 |
| 7,243,884 | B2 * | 7/2007 | Lawson et al. | 248/95 |
| 7,281,634 | B2 | 10/2007 | Marchetta et al. | |
| 2003/0164348 | A1 * | 9/2003 | Seng | 211/196 |
| 2004/0089624 | A1 * | 5/2004 | Farley | 211/119.03 |
| 2004/0108431 | A1 * | 6/2004 | Caron | 248/317 |
| 2005/0098517 | A1 * | 5/2005 | Reid | 211/86.01 |
| 2006/0255213 | A1 * | 11/2006 | Lawson et al. | 248/95 |
| 2007/0241072 | A1 * | 10/2007 | Bryant et al. | 211/90.02 |
| 2008/0034609 | A1 * | 2/2008 | Wolf et al. | 34/216 |
| 2009/0114610 | A1 * | 5/2009 | Rhoads, III | 211/85.3 |
| 2009/0242500 | A1 * | 10/2009 | Li | 211/116 |
| 2014/0124465 | A1 * | 5/2014 | Penner | 211/85.3 |

* cited by examiner

CLOTHES DRYING APPARATUS

BACKGROUND

The present invention relates to devices and methods for drying clothing.

After being washed, clothing needs to be dried. Drying clothing is commonly done by applying heat and agitation to the clothing (e.g., in a gas or electric dryer) or by hanging the clothing on a clothes line or drying rack. Clothes lines are typically positioned outdoors, so that an outdoor breeze can expedite the drying process. Drying racks are usually placed indoors and commonly include accordion-style legs that facilitate easy opening and closing of the rack. While these racks are inexpensive and easy to use, they take time to set up and can take up a lot of space.

SUMMARY

The present invention provides an apparatus for drying clothes that is easy to use and enhances the efficient use of space compared to a typical drying rack. In one embodiment, the invention provides a clothes drying apparatus mounted to a building structure (e.g., a ceiling, wall, or floor). The clothes drying apparatus includes a slider track coupled to the building structure, and a frame (e.g., at least two frames) secured to the slider track for sliding between a stored position and an extended position. The frame is pivotable relative to the building structure. For example, the frame can be secured to the slider track, and the slider track can be pivotable relative to the building structure. Preferably, the slider track includes an inner member coupled to the building structure and an outer member coupled to the frame.

In one embodiment, the slider track facilitates sliding in a longitudinal direction, and the frame is pivotable about an axis that is substantially parallel to the longitudinal direction. The apparatus can further include transverse brackets supporting the slider track. For special mounting situations, the apparatus can further include longitudinal brackets supporting the transverse brackets and/or a back mounting bracket at least partially supporting the transverse brackets.

Other aspects of the invention will become apparent by consideration of the detailed description and accompanying drawings.

DETAILED DESCRIPTION

Figure 1:
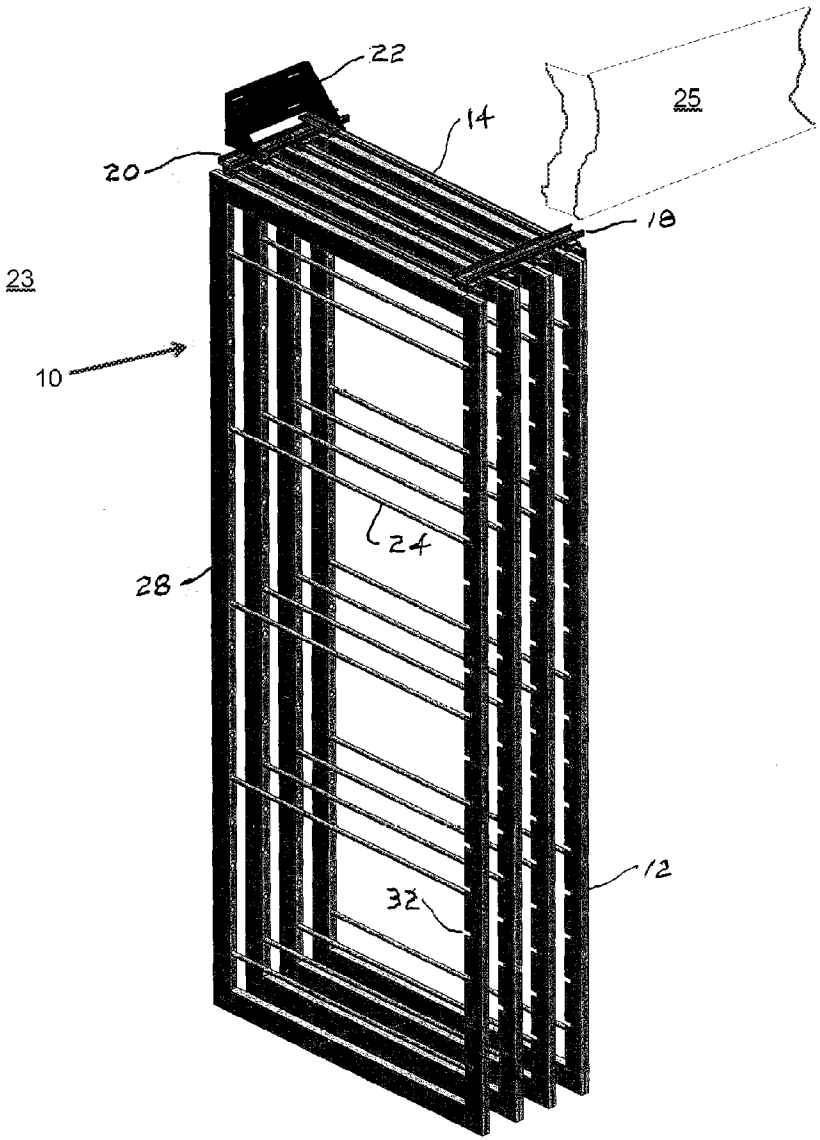
FIG. 1 is a perspective view of a clothes drying apparatus embodying the present invention.
Figure 2:
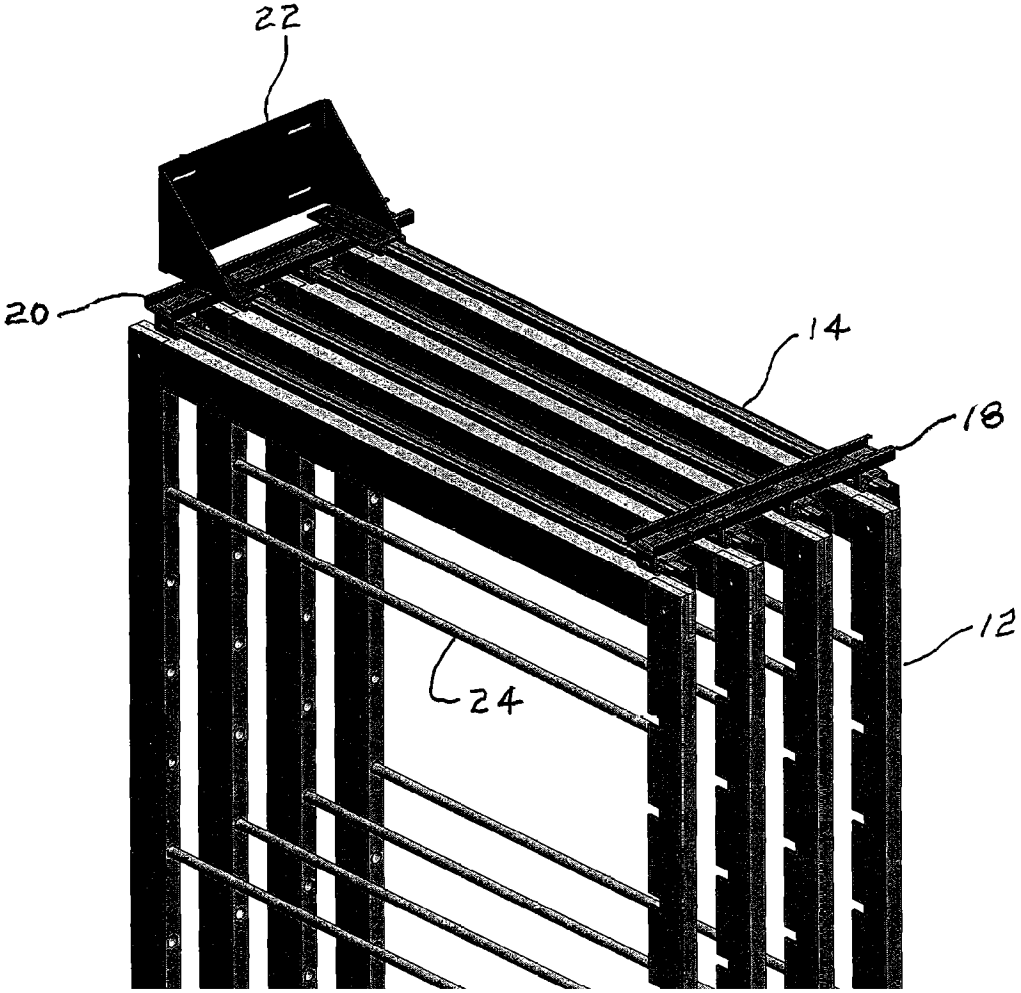
FIG. 2 is an enlarged perspective view of the apparatus of FIG. 1.
Figure 3:
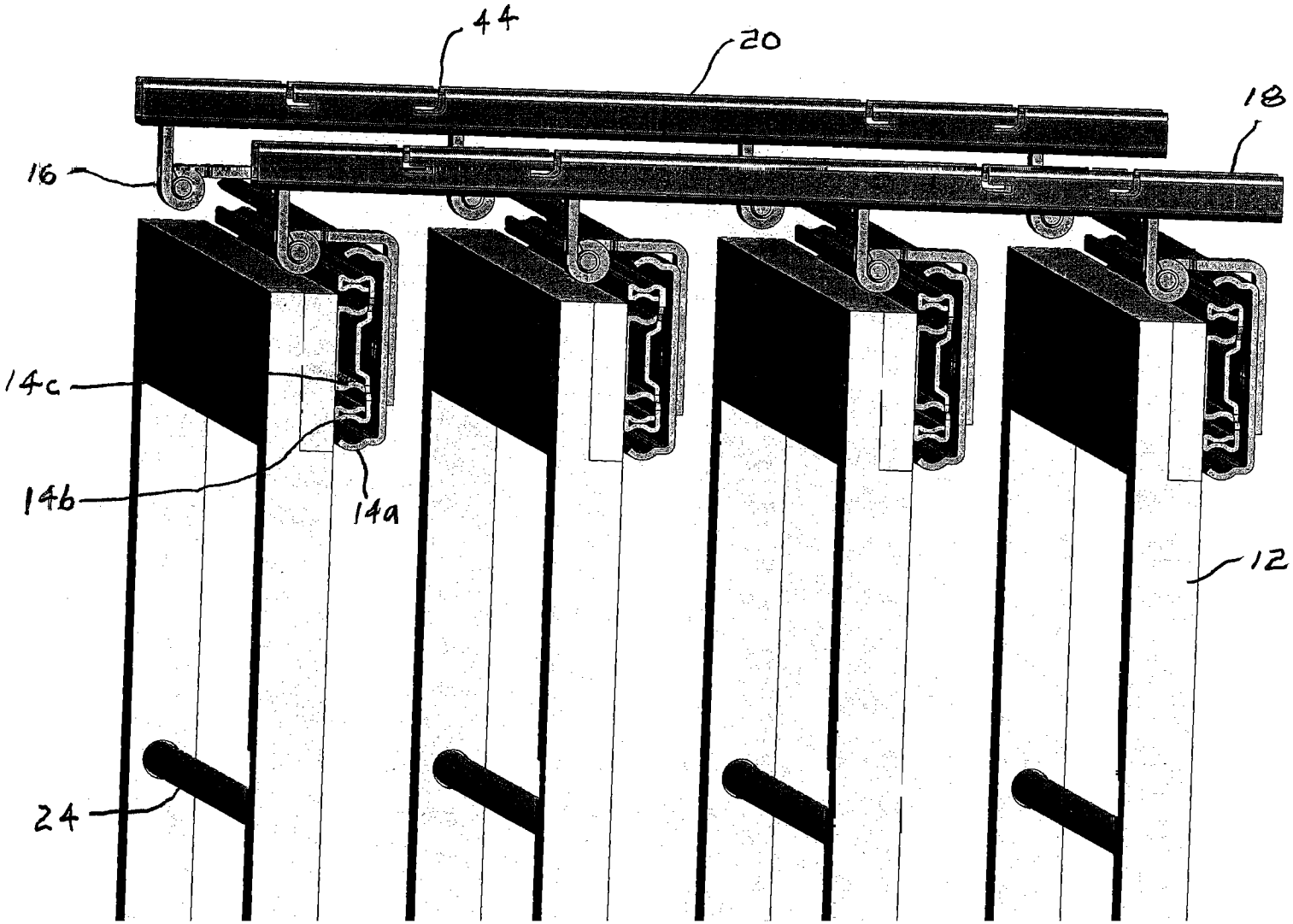
FIG. 3 is an enlarged perspective view of the apparatus of FIG. 1 with a back mounting bracket removed.
Figure 4:
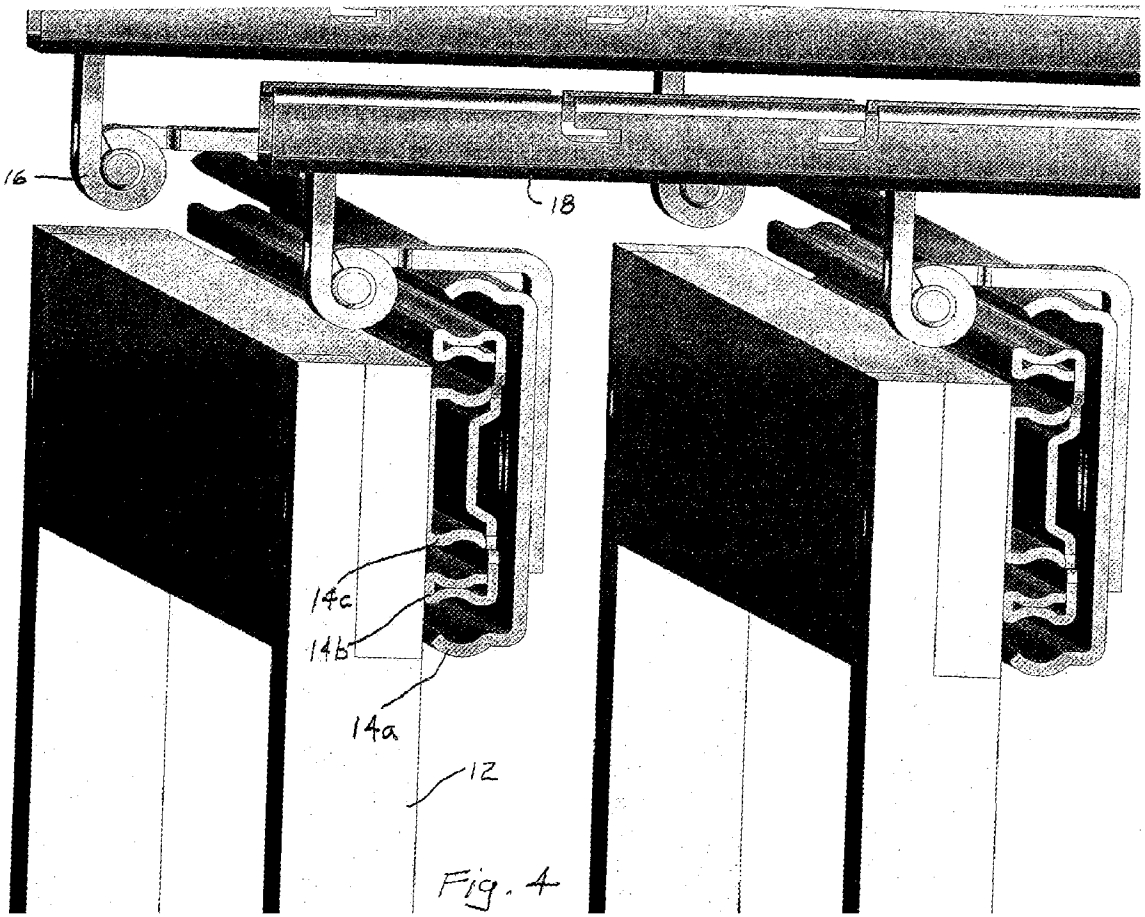
FIG. 4 is an enlarged perspective view of the apparatus of FIG. 3.
Figure 5:
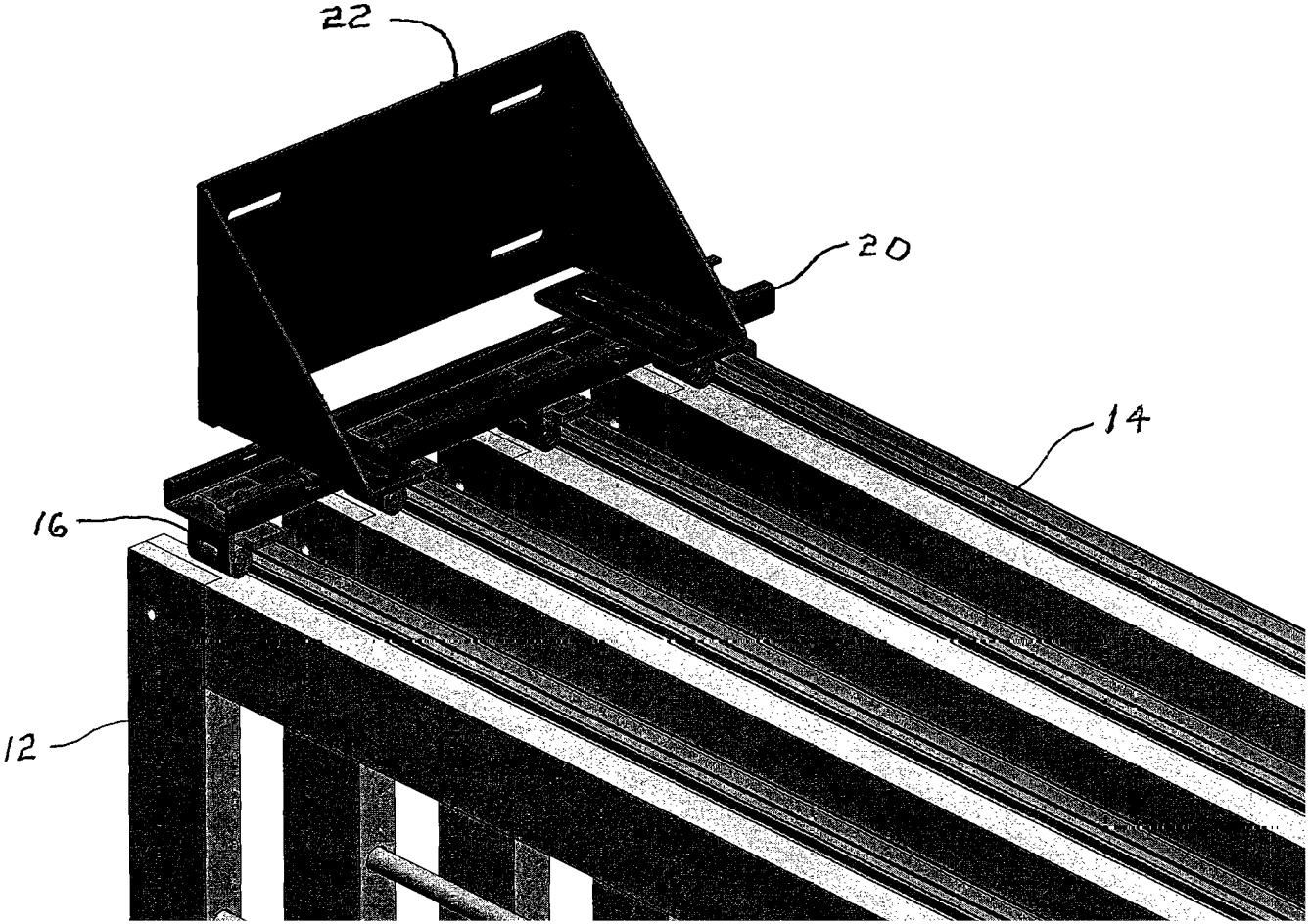
FIG. 5 is an enlarged perspective view of the apparatus of FIG. 1.
Figure 6:
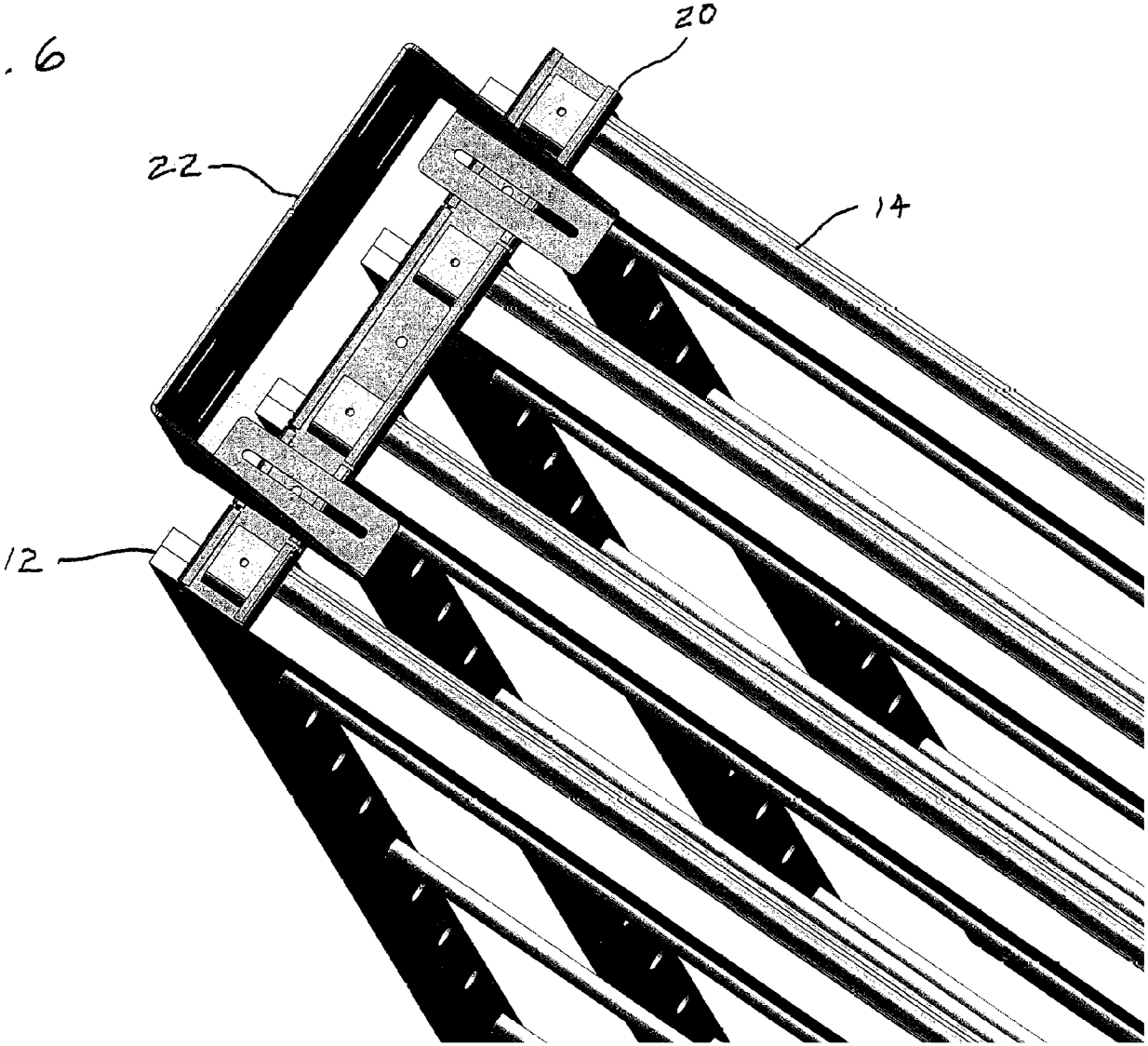
FIG. 6 is an upper perspective view of the apparatus of FIG. 5.
Figure 7:
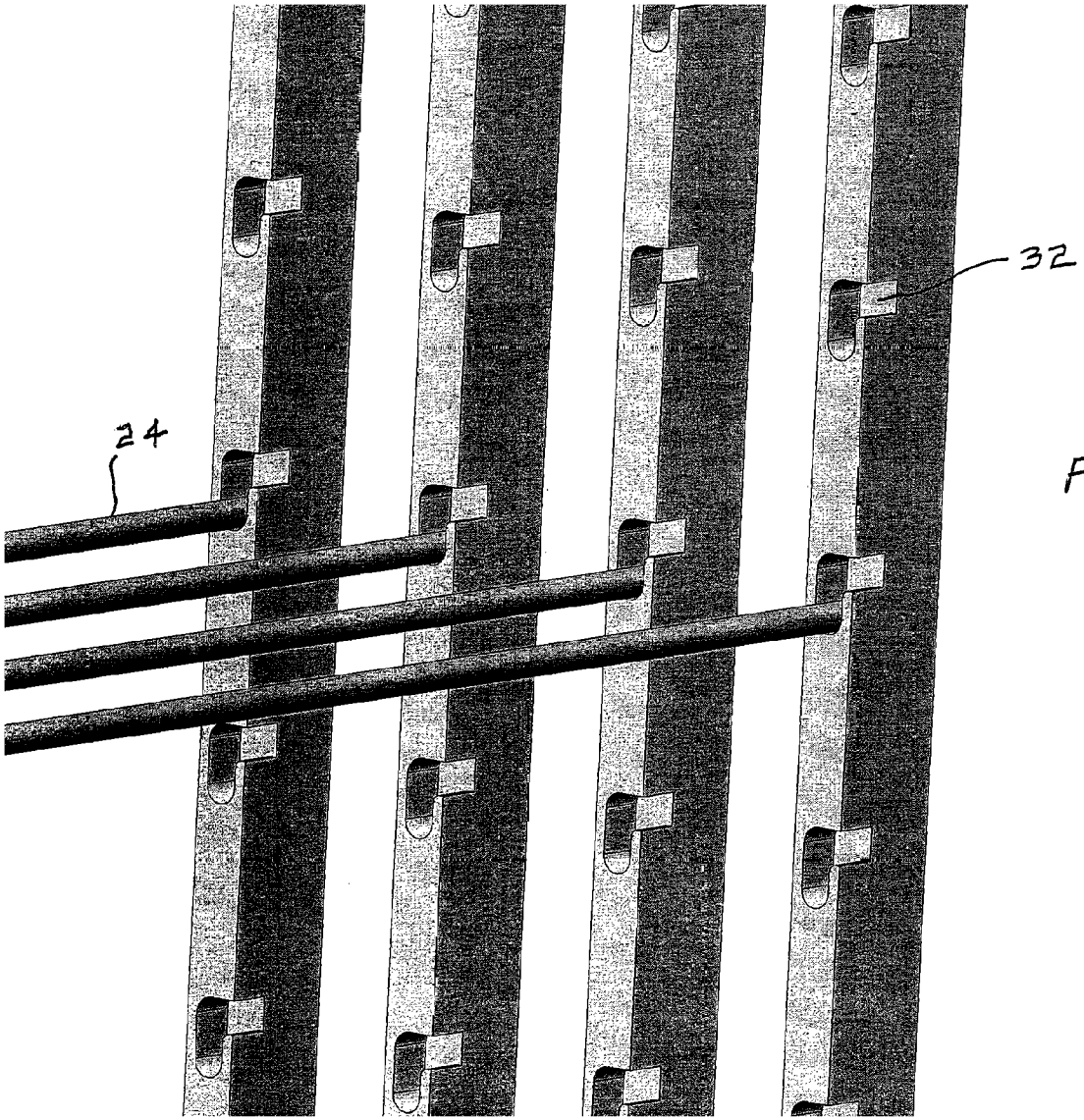
FIG. 7 is an enlarged perspective view of a portion of the apparatus of FIG. 1, including drying poles and L-slots.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

FIGS. 1-7 illustrate a clothes drying apparatus 10 mounted to a building structure (e.g., a floor, ceiling, wall of door header) including four vertical rectangular frames 12 that individually slide in and out on full-extension, three-piece telescoping slider tracks 14. Each slider track 14 includes a stationary portion/outer member 14*a*, an intermediate portion/middle member 14*b*, and an end portion/inner member 14*c* all of approximately equal lengths. Each frame 12 is secured to a corresponding end portions/inner member 14*c* of the sliding tracks. The three-piece slider tracks 14 are hung from pivoting hinges 16 attached to identical front and back C-channel brackets 18,20 at both ends of the stationary portion/outer member of the sliders. These brackets 18,20 support and evenly space out the frames 12 to allow air space between each drying rack for faster drying. The complete system can adjust to fit into most typical residential closets with the back C-channel bracket 20 attached to an additional back mounting bracket 22 secured to the back wall 23 of the closet with heavy duty drywall anchors while the front bracket 18 attaches to the underside of the closet header 25.

Each three-piece slider enables its corresponding frame to slide out the entire width of the frame for full access, similar to the slides of a common drawer. The pivoting motion of the frames allow the user to pull the neighboring frame out of the way so that the moving frame has more space to slide in and out without catching clothes on the frame next to it. The sliders have a quick release so that the inner member and drying frames can be individually removed from the support system.

Each side of the frame supports the ends of horizontal drying poles 24 for draping garments over to dry. The back side of the frame has a series of holes 28 spaced 3.5" apart running the height of the frame to fit one end of the drying poles, and the front side of the frame uses a similarly spaced series of upside down L slots 32 to slide the other end of each drying pole into and down to secure it from pulling off the frame. The top section 34 of the frame screws to the side of the end portion/inner member 14*c* of the corresponding telescoping slider track. The frame is squared and secured using lap joints. Normally the frames are all pushed back into the closet, and one at a time, the frames are pulled out, loaded with garments and pushed back into the closet to air dry with clothes out of site.

Figure 8:
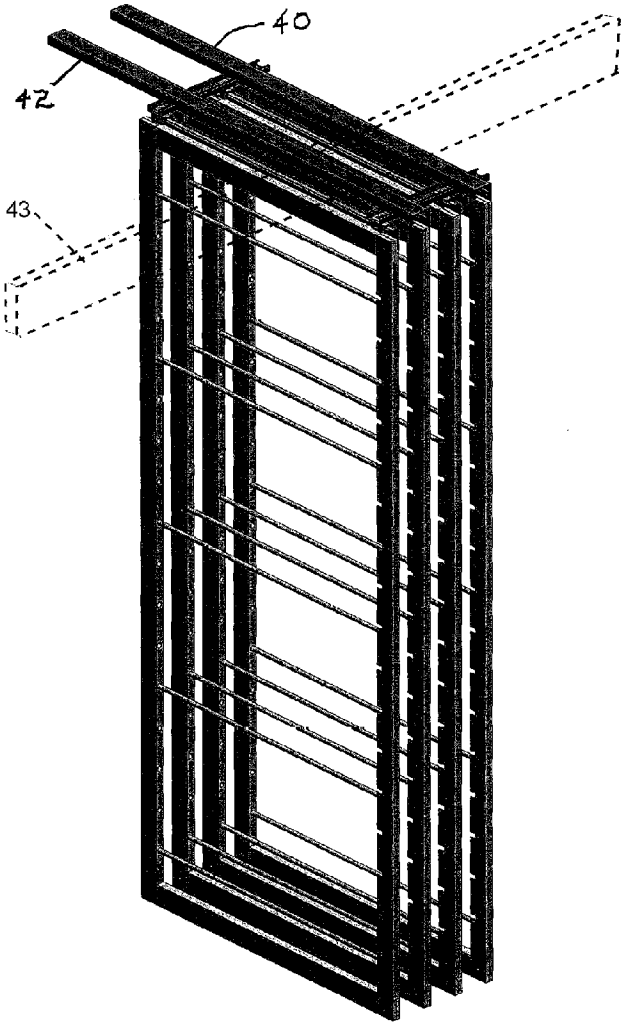
FIG. 8 is a perspective view of a second embodiment of the present invention.
Figure 9:
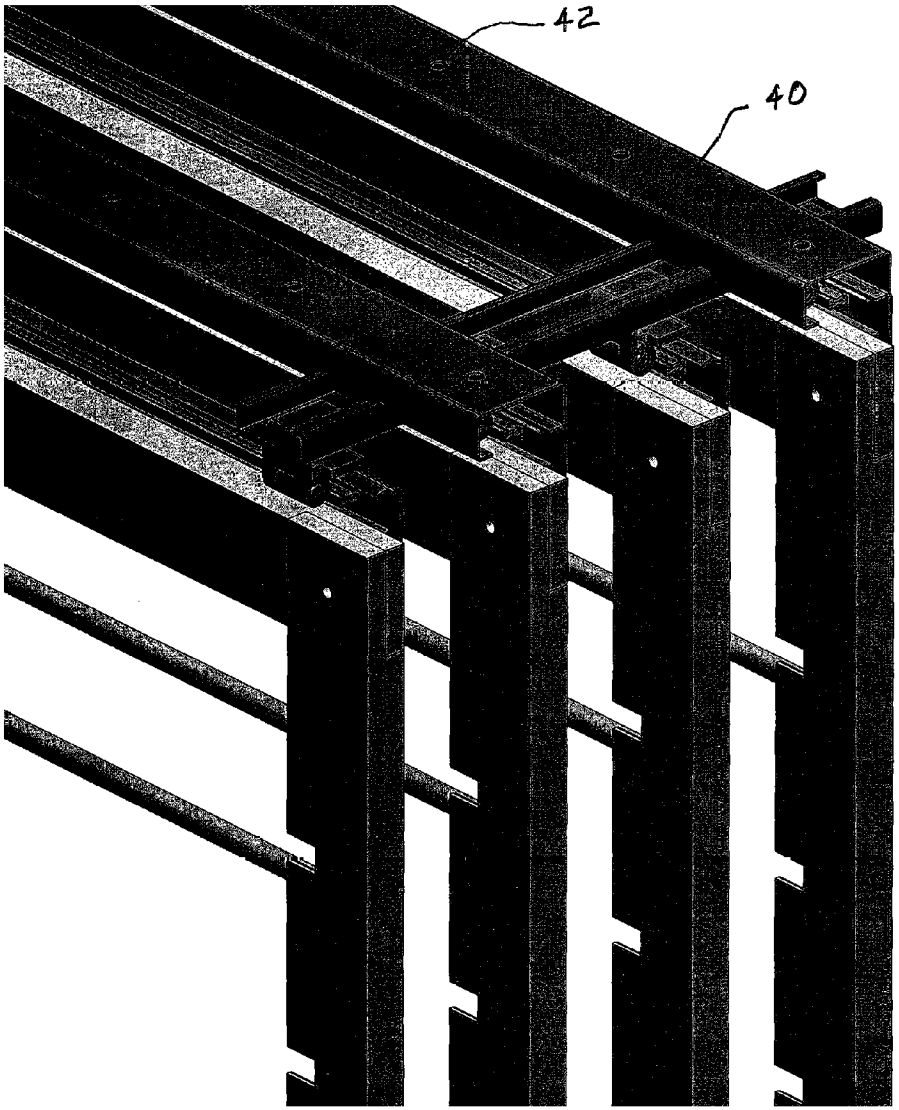
FIG. 9 is an enlarged perspective view of the apparatus of FIG. 8.
Figure 10:
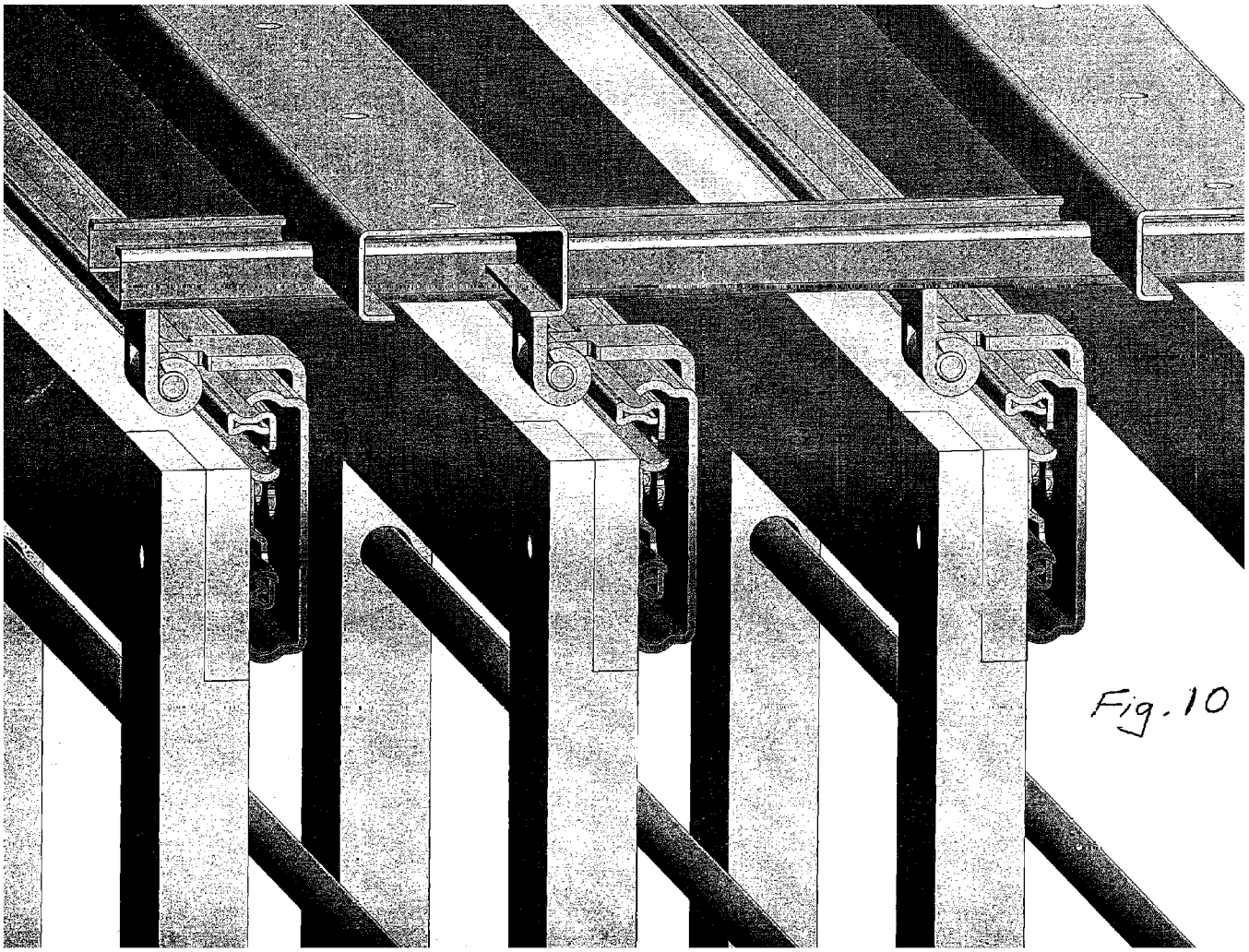
FIG. 10 is an enlarged perspective view of the apparatus of FIG. 9.

Referring to FIGS. 8-10, the above Clothes Drying Apparatus can also be installed in an open area by removing the back mounting bracket 22 and utilizing two 41" mounting brackets 40 with mounting holes 42 every 4". These mounting brackets 40 are mounted perpendicular to the ceiling joist 43 using wood screws to attach to the ceiling joist. Ceiling mounting should be secured to ceiling joists 43 for proper strength. The unique design of the front and back C-channel brackets 18,20 allows them to be mounted either perpendicular or parallel to the mounting brackets 40. When the frames are to run perpendicular to the ceiling joist, the slots 44 in the front and back C-channel brackets 18,20 enable the mounting brackets 40 an adjustable connection and support for the rest of the system (as shown in FIGS. 8-10). If the Ceiling joists run parallel to the frame direction, the front and back C-channel brackets 18,20 can slide and fit inside the mounting brackets 40 (not shown). This unique universal system accommodates all ceiling mounting situations using the same parts. The ceiling versions come with longer frame sides to extend them down to working height for an 8' or 9' ceiling.

The three versions of the clothes drying apparatus utilize nearly all the same parts with the exception of the different length frame sides and the mounting brackets 40 substituted for the back mounting bracket 22. On all the versions, the frames remain about one foot above the floor to provide storage space below and easy access for cleaning.

Figure 11:
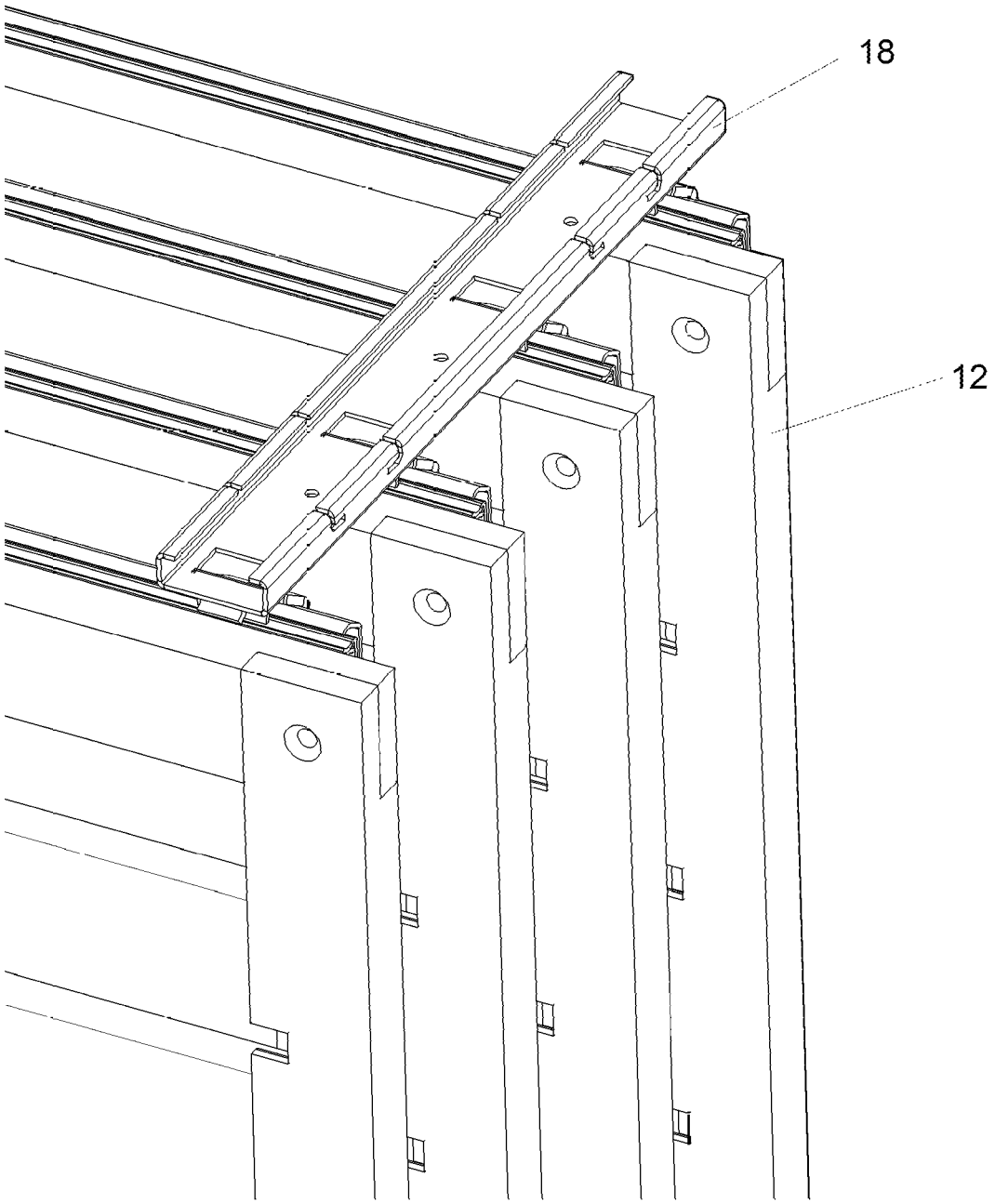
FIG. 11 is an enlarged perspective view of a third embodiment of the present invention.
Figure 12:
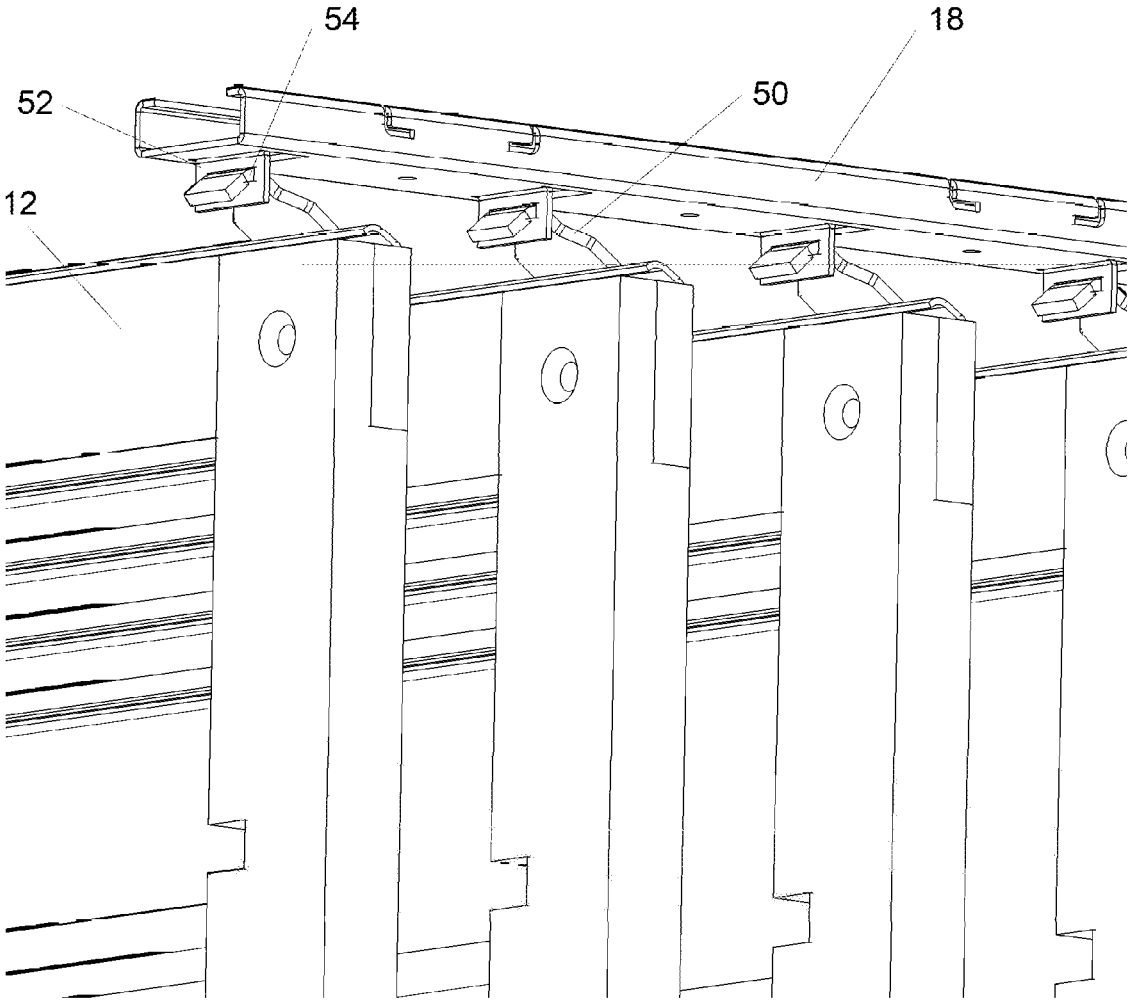
FIG. 12 is an enlarged perspective view of the apparatus of FIG. 11.
Figure 13:
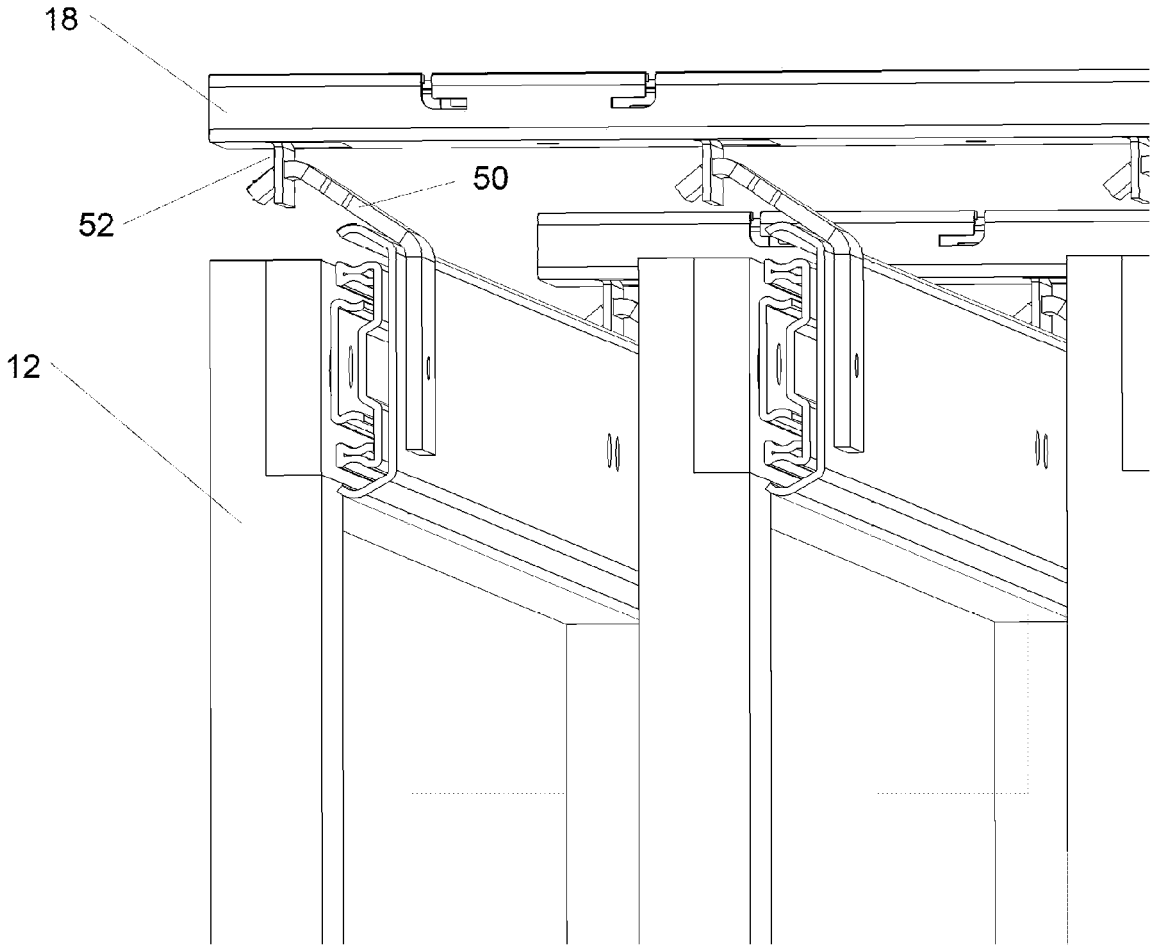
FIG. 13 is an enlarged perspective view of the apparatus of FIG. 11.

In the third embodiment of FIGS. 11-13, the pivoting hinges 16 of the first embodiment are replaced by J-shaped hanger brackets 50 that engage hanger tabs 52. The illustrated hanger brackets 50 are secured to corresponding outer members 14*a* of the slider track 14 (two hanger brackets 50 per slider track 14). The hanger tabs 52 are cut and bent from the C-channel brackets 18,20 and define an opening 54 for receiving a corresponding hanger bracket 50.

It can be seen that the hanger brackets 50 can pivot relative to the hanger tabs 52, and thus provide the same benefits provided by the pivoting hinges 16 noted in connection with the first two embodiments. That is, the ability of the frames to pivot relative to the stationary structure (e.g., the wall or ceiling) reduces the likelihood of damages to the apparatus in the event that the a lateral force is applied to the frame. In addition, the ability to pivot each frame relative to the other frames enhances the ease with which each frame can be slid into and out of the stored position. For example, when it is desired to slide a particular frame out of the stored position, adjacent frames can be pivoted away from the particular frame to thereby decrease the likelihood of clothing on the adjacent frames contacting the clothing on the particular frame. The same applies when one is sliding the particular frame from an extended position to the stored position Each hanger bracket 50 can be inserted into and removed from the opening 54 in a corresponding hanger tab 52 to facilitate easy installation and removal of the apparatus. More specifically, when installing the apparatus 10, the C-channel brackets 18,20 can be mounted as desired (e.g., utilizing the mounting brackets 40) and each slider track 14 (or at least the outer member 14*a* of each slider track 14) can be hung on the C-channel brackets 18,20 using the hanger brackets 50. After the slider tracks 14 are hung on the C-channel brackets 18,20, each frame 12 can be attached to the corresponding slider track 14.

Various features and advantages of the invention are set forth in the following claims.

What is claimed is:

1. A clothes drying apparatus mounted to a structure comprising:

a building structure;

a slider track coupled to the building structure; and a frame secured to the slider track for sliding in a longitudinal direction between a stored position and an extended position, the frame includes a drying member adapted to support clothing in both the stored position and the extended position, the frame being pivotable about an axis that is substantially parallel to the longitudinal direction.

2. A clothes drying apparatus as claimed in claim 1, wherein the building structure comprises at least one of a ceiling, wall, or floor.

3. A clothes drying apparatus as claimed in claim 1, wherein the slider track is pivotable relative to the building structure.

4. A clothes drying apparatus as claimed in claim 1, further comprising a mounting bracket secured to the building structure, wherein the slider track is pivotally secured to the mounting bracket.

5. A clothes drying apparatus as claimed in claim 4, wherein the frame is secure to the slider track.

6. A clothes drying apparatus as claimed in claim 1, wherein the slider track includes an inner member coupled to the building structure and an outer member coupled to the frame.

7. A clothes drying apparatus as claimed in claim 1, wherein the slider track facilitates sliding along a longitudinal axis and wherein the apparatus further includes transverse brackets supporting the slider track.

8. A clothes drying apparatus as claimed in claim 7, wherein the frame comprises at least two frames, wherein the at least two frames are all supported by the transverse brackets.

9. A clothes drying apparatus as claimed in claim 7, wherein the apparatus further includes longitudinal brackets supporting the transverse brackets.

10. A clothes drying apparatus as claimed in claim 7, wherein the apparatus further includes a back mounting bracket coupled to and at least partially supporting the transverse brackets.

11. A clothes drying apparatus comprising:

transverse brackets;

a slider track coupled to the transverse brackets;

a frame secured to the slider track for sliding in a longitudinal direction between a stored position and an extended position, the frame includes a drying member adapted to support clothing in both the stored position and the extended position, the frame being pivotable about an axis that is substantially parallel to the longitudinal direction.

12. A clothes drying apparatus as claimed in claim 11, wherein the slider track is pivotable relative to the transverse brackets.

13. A clothes drying apparatus as claimed in claim 11, wherein the slider track includes an inner member coupled to the transverse brackets and an outer member coupled to the frame.

14. A clothes drying apparatus as claimed in claim 11, wherein the frame includes at least two frames and wherein the at least two frames are all supported by the transverse brackets.

15. A clothes drying apparatus as claimed in claim 11, wherein the slider track facilitates sliding along a longitudinal axis and wherein the transverse brackets are substantially perpendicular to the longitudinal axis.

16. A clothes drying apparatus as claimed in claim 15, wherein the frame comprises at least two frames, wherein the at least two frames are all supported by the transverse brackets.

17. A clothes drying apparatus as claimed in claim 15, wherein the apparatus further includes longitudinal brackets supporting the transverse brackets.

18. A clothes drying apparatus as claimed in claim 15, wherein the apparatus further includes a back mounting bracket coupled to and at least partially supporting the transverse brackets.

* * * * *